US006239750B1

(12) United States Patent
Snygg

(10) Patent No.: US 6,239,750 B1
(45) Date of Patent: May 29, 2001

(54) ANTENNA ARRANGEMENT

(75) Inventor: Göran Snygg, Partille (SE)

(73) Assignee: Telefonaltiebolaget LM Ericsson (publ), Stockholm (SE)

( * ) Notice: Subject to any disclaimer, the term of this patent is extended or adjusted under 35 U.S.C. 154(b) by 0 days.

(21) Appl. No.: 09/383,732

(22) Filed: Aug. 26, 1999

(30) Foreign Application Priority Data

Aug. 28, 1998 (SE) ..... 9802883

(51) Int. Cl.[7] ..... H01Q 1/38

(52) U.S. Cl. ..... 343/700 MS; 343/829; 343/846

(58) Field of Search ..... 343/700 MS, 829, 343/830, 846

(56) References Cited

U.S. PATENT DOCUMENTS

| | | | | |
|---|---|---|---|---|
| 4,903,033 | * | 2/1990 | Tsao et al. | 343/700 MS |
| 5,003,318 | * | 3/1991 | Berneking et al. | 343/700 MS |
| 5,300,936 | * | 4/1994 | Izadian | 343/700 MS |
| 5,307,075 | * | 4/1994 | Huynh | 343/700 MS |
| 5,680,144 | | 10/1997 | Sanad | 343/700 MS |
| 5,952,971 | * | 9/1999 | Strickland | 343/700 MS |

FOREIGN PATENT DOCUMENTS

| | | | |
|---|---|---|---|
| 0 207 029 | 12/1986 | (EP) | H01Q/1/38 |
| 2 147 744 | 5/1985 | (GB) | H01Q/1/38 |
| 95/07557 | 3/1995 | (WO) | H01Q/5/00 |
| 98/37592 | 8/1998 | (WO) | H01Q/5/00 |

* cited by examiner

*Primary Examiner*—Don Wong
*Assistant Examiner*—Hoang Nguyen
(74) *Attorney, Agent, or Firm*—Burns, Doane, Swecker & Mathis, L.L.P.

(57) ABSTRACT

An antenna arrangement for multi frequency band operation makes it possible to reduce the number of antennae on a base station antenna mast. The antenna includes a first radiator element for operation in a first frequency band and a second radiator element for operation in a second frequency band. The second element is arranged in a different plane from said first element. The first element is placed so that it symmetrically overlaps the second element. A conductive ground plane is provided with a device for feeding energy to the radiator elements, and the radiator elements are arranged for providing dual polarization. An array antenna includes groups of high and low frequency elements.

28 Claims, 4 Drawing Sheets

ANTENNA ARRANGEMENT

The present invention relates to an antenna arrangement for multi frequency band operation, comprising a first radiator element for operation in a first frequency band and a second radiator element for operation in a second frequency band, wherein said second element is arranged in a different plane from said first element. The invention also relates to an array antenna arrangement comprising groups of first and second elements. Also, the invention relates to the use of such an antenna arrangement.

BACKGROUND

A large number of base station antenna installations have been necessary for the operation of cellular mobile telecommunication systems. Base station antenna arrangements have to be provided all over the area that is to be covered by the cellular communication system and how they are arranged among other things depends on the quality that is required and the geographical coverage, the distribution of mobile units etc. Since radio propagation depends very much on terrain and irregularities in the landscape and the cities the base station antenna arrangements have to be arranged more or less closely.

However, the installation of multiple antenna base stations has caused protests among others from an esthetical point of view both on the countryside and in the cities. Also, the construction of these antenna masts is expensive, e.g. because each antenna needs to be supplied with energy via a separate, expensive feeding cable.

The introduction of new base station antenna arrangements would be considerably facilitated if the infrastructure that already is in place could be better used. Today various examples of microstrip antenna elements which are capable of operating in two distinct frequency bands are known. However, it is difficult to avoid grating lobes when the frequency bands are not closely spaced.

SUMMARY

An object of the invention is therefore to provide a multi frequency band antenna which does not present the above described problems. Another object of the invention is to provide an antenna which operates with different polarization states.

For these objects, the antenna arrangement in accordance with the invention is characterized in accordance with the accompanying independent claims.

Advantageous embodiments of the invention are described in the accompanying depending claims.

It is an advantage of the invention that the existing infrastructure already provided for the 800 or 900 MHz frequency band can be used also for new frequency bands such as about 1800 MHz or 1900 MHz. It is also an advantage of the invention that the antenna elements or the radiating elements are simple and flexible and enables a simple feeding etc. It is also an advantage that dual polarization states can be supported with a high mutual insulation.

BRIEF DESCRIPTION OF THE DRAWINGS

The invention will be further described in the following in a non-limiting way under reference to the accompanying drawings in which.

DETAILED DESCRIPTION

Figure 1A:
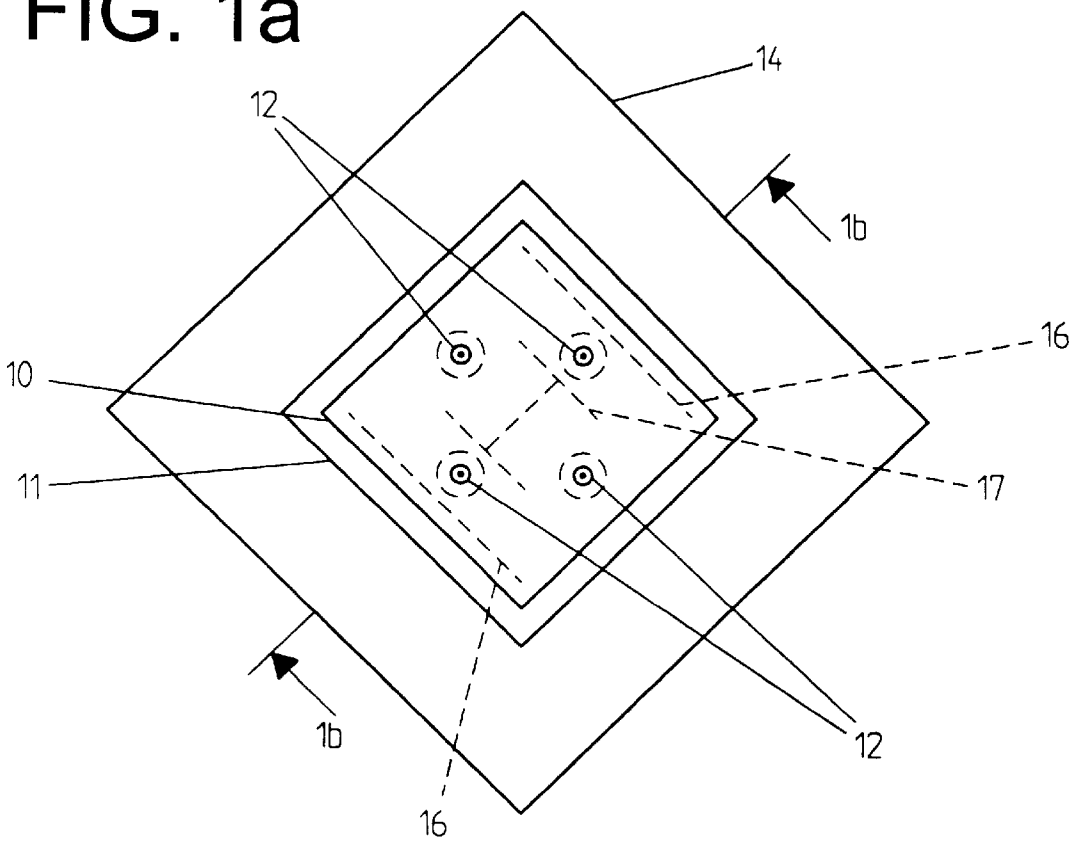
FIG 1*a* is a top view of a multi frequency antenna arrangement according to the invention.
Figure 1B:
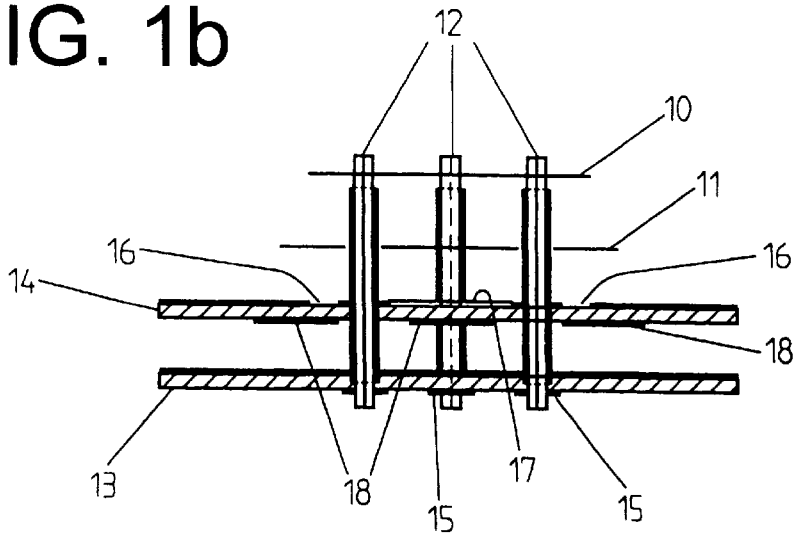
FIG 1*b* is a schematical cross-sectional view of the antenna of FIG. 1A along the lines 1*b*—1*b*.

FIGS. 1*a* and 1*b* illustrate a first example of a microstrip antenna which is able to operate (receive/transmit) at two different frequencies or in two different frequency bands simultaneously. In FIG. 1*a*, which is a top view of the antenna, a first radiating element 10 is arranged on top. The first radiating element 10 is here square shaped. A second radiating element 11 is arranged below the first radiating element. The second radiating element is symmetrically arranged in a centralized manner under the first radiating element. The first and second radiating elements 10, 11 respectively particularly comprise so called patch elements made of a conducting material, for example Cu.

The first patch element or radiating element 10 may be used for a communication system operating in frequency band of about 1800–1900 MHz whereas the second radiating element 11 may be used for a communication system operating in the frequency band of about 800–900 MHz. To facilitate this, the first and the second radiating elements have the appropriate effective resonant dimension respectively, in accordance with common practice, and in view of the effective dielectric constant of the dielectric material or medium, e.g. air which is used for insulating the first and the second patch.

In FIGS. 1*a*, 1*b* the first radiating element 10 is mounted on two orthogonally arranged pairs of probes 12 that are responsible for energizing this element in two directions of polarization with a mutual angle of about 90°. The probes 12 extend via holes through the second element 11 and are mounted on a first layer 13 of a ground plane that also comprises a second layer 14. The ground plane layer 13 is provided with an electric feed network 15 for supplying the probes with energy in the two angles of polarization.

The lower, second radiating element, i.e. the low frequency band patch 11 is aperture fed from the second ground plane layer 14 via an aperture arrangement comprising slots 16 and 17. The outer slots 16 are oriented according to one of the polarization angles and the inner H-shaped slot 17 is oriented according to the other angle. The polarization is perpendicular to the long dimension of the slots. The ground plane layer 14 is provided with an electric feed net 18 for supplying the slots with energy in the two angles of polarization. The above described slot configuration is only one example, many alternative slot configurations are possible, for example with crossing slots.

In alternative embodiments of the above described antenna, the second element may be energized by probes and this element may be provided with slot apertures for energizing the first element. The patches may have other shapes than square. The antenna may comprise any number of stacked elements for different frequencies, depending on the number of frequencies to be used in the antenna. The above described antenna module may be used in a multiple module array antenna.

In the above described embodiment, it is possible to feed both patches by means of the four probes 12. In this manner, a single power feed network may be used for energizing both patches.

Figure 2A:
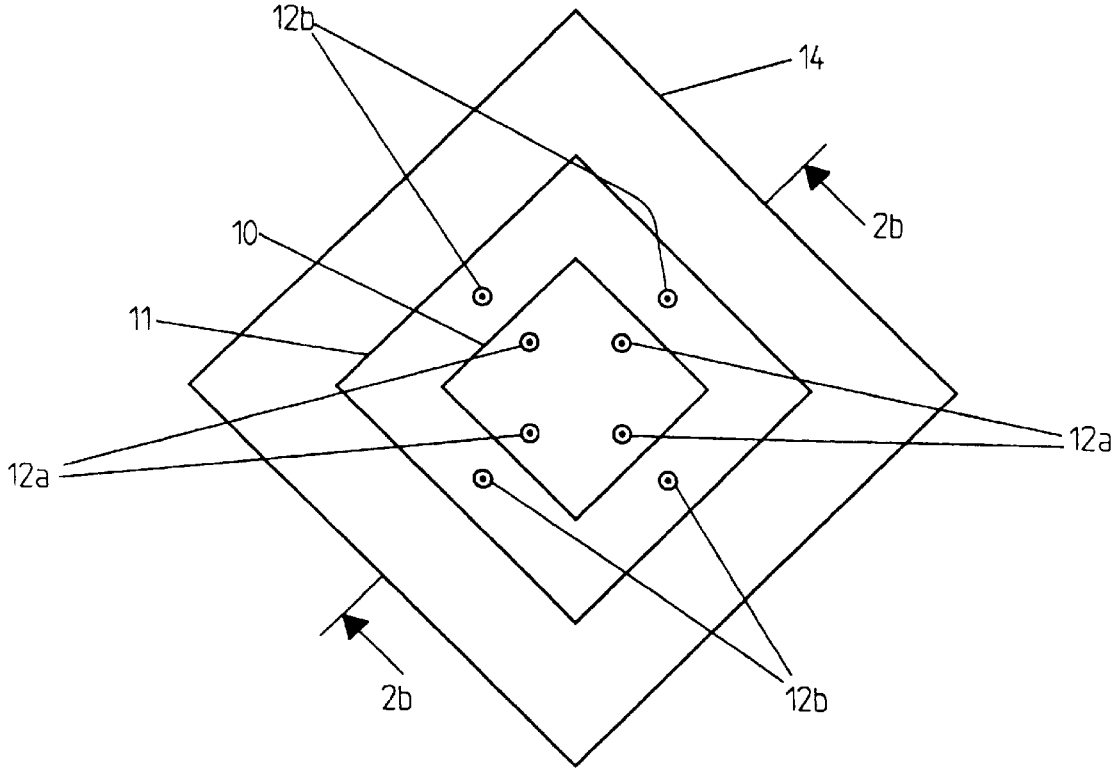
FIG. 2*a* is a top view of an alternative embodiment of an antenna according to the invention.
Figure 2B:
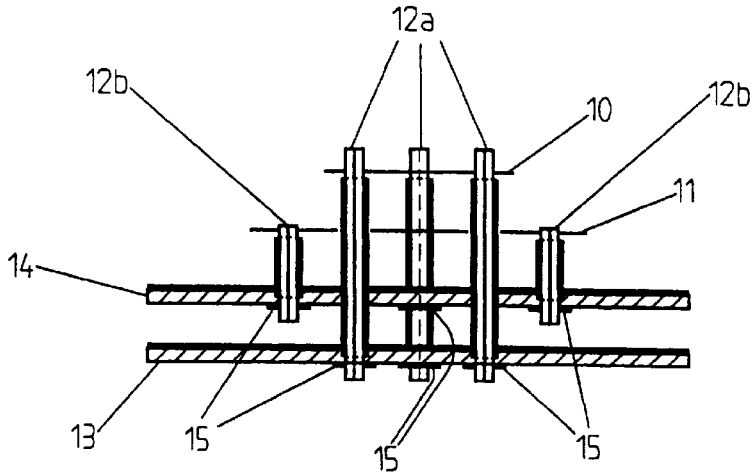
FIG. 2*b* is a schematical cross-sectional view of the antenna of FIG. 2A along the lines 2*b*—2*b*.

FIGS. 2*a* and 2*b* show an alternative example of a microstrip antenna which is able to operate (receive/transmit) at two different frequencies or in two different frequency bands simultaneously. The same reference numbers have been used as in FIG. 1*a* and 1*b* to designate the corresponding details.

As in the first embodiment of the invention, in FIG. 2*a*, which is a top view of the antenna, a first radiating element 10 is arranged on top. A second radiating element 11 is arranged below the first radiating element, symmetrically arranged in a centralized manner under the first radiating element.

The first patch element or radiating element 10 may be used for a communication system operating in frequency band of about 1800–1900 MHz whereas the second radiating element 11 may be used for a communication system operating in the frequency band of about 800–900 MHz.

In FIGS. 2*a*, 2*b* the first radiating element 10 is mounted on two orthogonally arranged pairs of probes 12*a* that are responsible for energizing this element in two directions of polarization with a mutual angle of about 90. The probes 12*a* extend via holes through the second element 11 and are mounted on a first layer 13 of a ground plane that also comprises a second layer 14. The ground plane layer 13 is provided with an electric feed net 15 for supplying the probes with energy in the two angles of polarization.

The lower, second radiating element, i.e. the low frequency band patch 11 is probe fed from the second ground plane layer 14 via probes 12*b*. Thus, the patch 11 is mounted on two orthogonally arranged pairs of probes 12*b*. One pair of probes 12*b* is oriented according to one of the polarization angles and the other pair of probes is oriented according to the other angle. The ground plane layer 14 is provided with an electric feed net 18 for supplying the probes with energy in the two angles of polarization.

In alternative embodiments of the above described antenna, the patches may have other shapes than square. The antenna may comprise any number-of stacked elements for different frequencies, depending on the number of frequencies to be used in the antenna. The above described antenna module may be used in a multiple module array antenna.

Figure 3A:
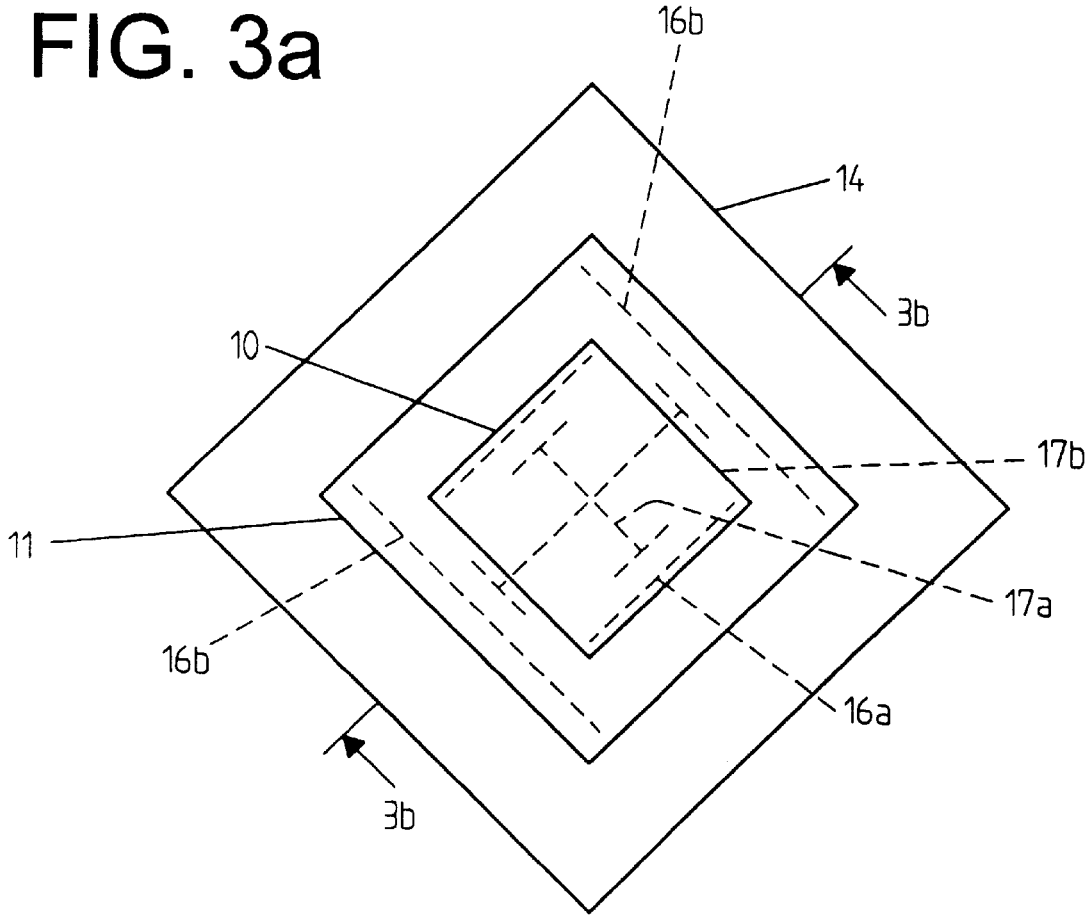
FIG. 3*a* is a top view of a third embodiment of an antenna according to the invention.
Figure 3B:
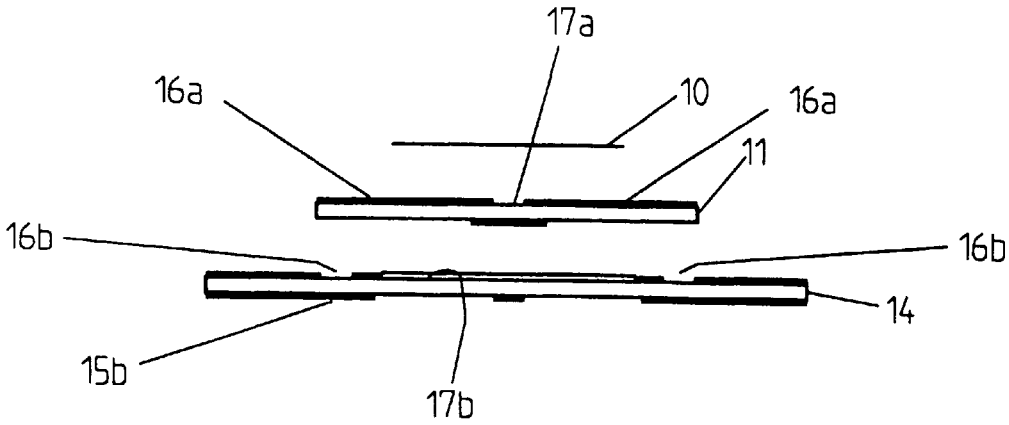
FIG. 3*b* is a cross-sectional view of the arrangement of FIG. 3A along the lines 3B—3B.

FIGS. 3*a* and 3*b* show a third example of a microstrip antenna in accordance with the invention which is able to operate (receive/transmit) at two different frequencies or in two different frequency bands simultaneously. The same reference numbers have been used as in FIGS. 1*a*, 1*b*, 2*a* and 2*b* to designate the corresponding details.

As in the first embodiment of the invention, in FIG. 3*a*, which is a top view of the antenna, a first radiating element 10 is arranged on top. A second radiating element 11 is arranged below the first radiating element, symmetrically arranged in a centralized manner under the first radiating element.

The first patch element or radiating element 10 may be used for a communication system operating in frequency band of about 1800–1900 MHz whereas the second radiating element 11 may be used for a communication system operating in the frequency band of about 800–900 MHz.

In FIGS. 3*a*, 3*b* the first radiating element 10 is energized via aperture slots 16*a* and 17*a* in the second radiating element 11. The outer slots 16*a* are oriented according to one of the polarization angles and the inner H-shaped slot 17*a* is oriented according to the other angle. The element 11 is provided with an electric feed net 15*a* for supplying the aperture slots with energy in the two angles of polarization.

The lower, second radiating element, i.e. the low frequency band patch 11 is aperture fed from the ground plane 14 via slots 16*b*and 17*b*. The outer slots 16*b* are oriented according to one of the polarization angles and the inner H-shaped slot 17*b* is oriented according to the other angle. The polarization is perpendicular to the long dimension of the slot. The ground plane layer 14 is provided with an electric feed net 15*b* for supplying the slots with energy in the two angles of polarization.

In alternative embodiments of the above described antenna, the patches may have other shapes than square. The antenna may comprise any number of stacked elements for different frequencies, depending on the number of frequencies to be used in the antenna. The above described antenna module may be used in a multiple module array antenna. The second element 11 may be designed so that it is transparent with reference to the frequency of the first element 10, by e.g. incorporating FSS (Frequency Sensitive Surface) technics. In this way it is possible to have the slots for the two elements in a common ground plane.

Figure 4:
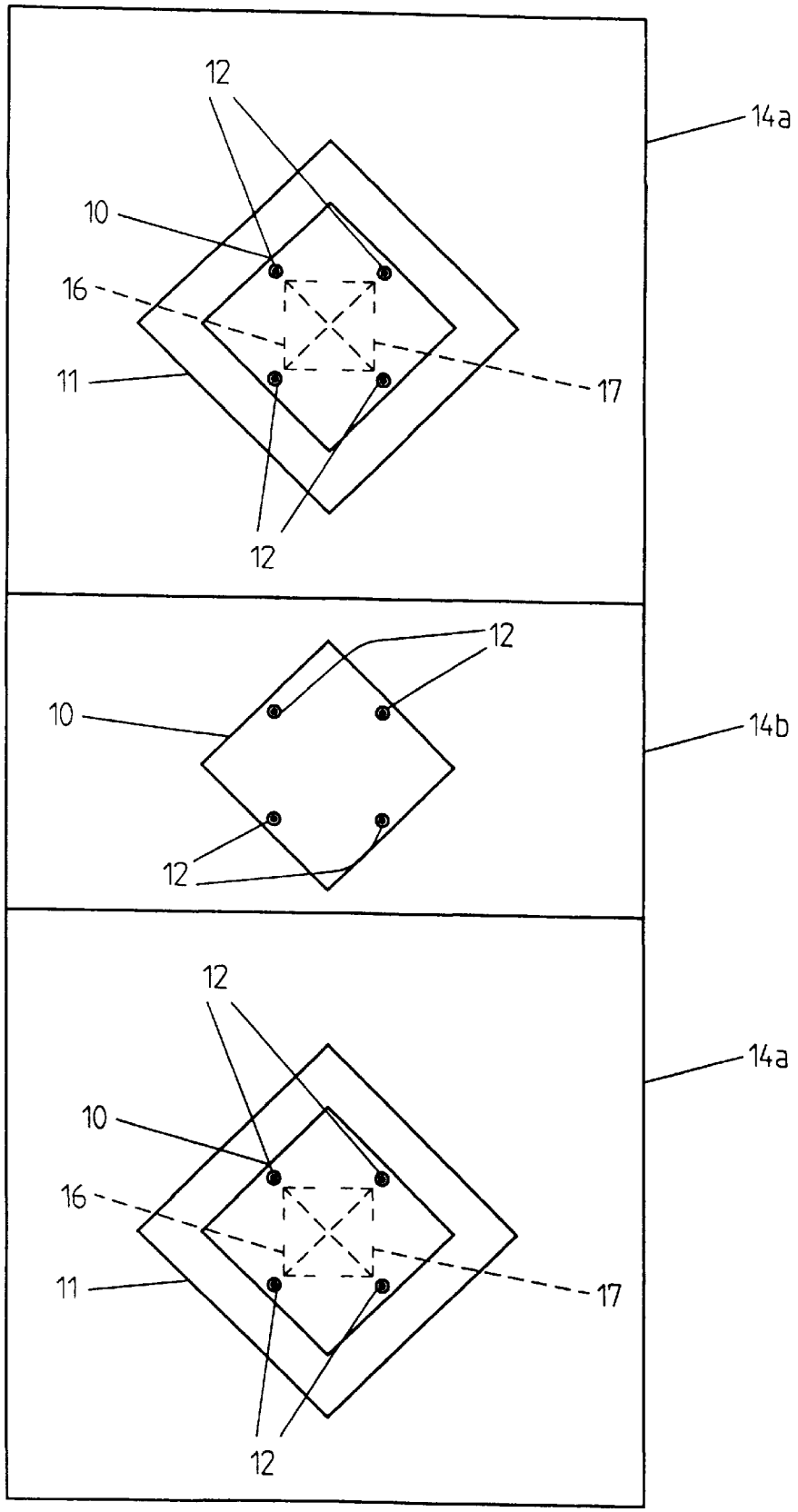
FIG. 4 is a top view of an array antenna according to the invention.

FIG. 4 shows an array antenna in accordance with the invention, which in this example comprises three groups of elements, but any number of such groups is possible. Two of the element groups are similar to the example shown in FIGS. 1*a* and 1*b*. Between these two element groups is a third element group comprising an extra element 10 of the first high frequency type. This configuration may be suitable for avoiding grating lobes. The ground plane 14*a* preferably continues below the central group of elements, and the ground plane 14*b* of the central high frequency patch 10 preferably is arranged at the same level as the second elements 11 of the two lateral groups of elements. The central high frequency patch 10 is powered by probes 12.

The elements in FIG. 4 are oriented so that the polarization directions are ±45° with respect to the long dimension of the array. Any other directions, e.g. 0° and 90° may be used. The element groups of the array antenna may also be arranged in two dimensions.

In any of the above described antennas the two linear polarizations may be combined to form one or two circular. polarizations.

The invention is of course not limited to the shown embodiments but it can varied in a number of ways only being limited by the scope of the claims. For example, any number of probes may be used in the antenna as long as they are symmetrically oriented around the axes of polarization. Rectangular, circular, oval or any other form of patches may be used.

What is claimed is:

1. An antenna arrangement for multi frequency band operation, comprising a first radiator element for operation in a first frequency band and a second radiator element for operation in a second frequency band, wherein said second element is arranged in a different plane from said first element, the first element is placed so that it symmetrically overlaps the second element, a conductive ground plane is provided with means for feeding energy to the radiator elements, and the radiator elements are arranged for providing dual polarization.

2. An antenna arrangement according to claim 1, further comprising probes for energizing the first radiator element.

3. An antenna arrangement according to claim 2, wherein the probes are arranged symmetrically around the two axes of polarization.

4. An antenna arrangement according to claim 2, wherein the probes are used as distancing means for positioning the first and the second elements.

5. An antenna arrangement according to claim 1, further comprising probes for energizing the second radiator element.

6. An antenna arrangement according to claim 1, wherein the probes comprise two pairs of probes arranged orthogonally in relation to each other for providing dual polarization.

7. An antenna arrangement according to claim 1, wherein the second element is energized by an aperture arrangement in the ground plane.

8. An antenna arrangement according to claim 7, wherein for feeding energy to the second element, a first aperture arrangement and a second aperture arrangement are provided in the ground plane, the first aperture arrangement providing a signal having a first polarization and the second aperture arrangement providing a signal having a second polarization.

9. An antenna arrangement according to claim 1, wherein the first element is energized by an aperture arrangement in the second element.

10. An antenna arrangement according to claim 1, wherein the second element is transparent with reference to the frequency of the first element.

11. An antenna arrangement according to claim 10, wherein the two elements have a common ground plane.

12. An antenna arrangement according to claim 1, wherein said antenna arrangement is used as a base station antenna arrangement for mobile telecommunications.

13. An antenna arrangement according to claim 12, wherein the low frequency element operates in the 800–900 MHz frequency band and the high frequency element operates in approximately the 1800–2100 MHz frequency band.

14. An antenna arrangement according to claim 13, wherein the low frequency element operates in NMT 900, AMPS, TACS, GSM, or PDC, and the high frequency element operates in DCS 1800, PCS 1900, or WCDMA.

15. An array antenna for multi frequency band operation, comprising a group of radiator elements including high frequency radiator elements for operation in a first frequency band and low frequency radiator elements for operation in a second frequency band, wherein said low frequency elements are arranged in a different plane from the high frequency elements, each low frequency radiator element is arranged so that it is symmetrically overlapped by a high frequency element, a conductive ground plane is provided with means for feeding energy to the radiating elements, and the radiator elements are arranged for providing dual polarization.

16. An array antenna according to claim 15, further comprising probes for energizing each high frequency element.

17. An array antenna according to claim 16, further comprising probes for energizing each low frequency element.

18. An array antenna according to claim 16, wherein the probes are symmetrically placed around the two axes of polarization.

19. An array antenna according to claim 16, wherein the probes are used as distancing means for positioning the high frequency radiator elements and the low frequency radiator elements.

20. An array antenna according to claim 15, wherein the probes comprise two pairs of probes arranged orthogonally in relation to each other for providing dual polarization.

21. An array antenna according to claim 15, wherein each low frequency element is energized by means of a respective aperture arrangement in the ground plane.

22. An array antenna according to claim 21, wherein for feeding energy to each low frequency element, a first aperture arrangement and a second aperture arrangement are provided in the ground plane, the first aperture arrangement providing a signal having a first polarization and the second aperture arrangement providing a signal having a second polarization.

23. An array antenna according to claim 15, wherein the high frequency radiator element is energized by means of an aperture arrangement in the low frequency radiator element.

24. An antenna arrangement according to claim 15, wherein the low frequency elements are transparent with reference to the frequency of the high frequency elements.

25. An antenna arrangement according to claim 24, wherein the radiator elements have a common ground plane.

26. An array antenna according to claim 15, wherein said array antenna is used as a base station antenna arrangement for mobile telecommunications.

27. An array antenna according to claim 26, wherein the low frequency elements operate in the 800–900 MHz frequency band and the high frequency elements operate in approximately the 1800–2100 MHz frequency band.

28. An array antenna according to claim 27, wherein the low frequency elements operate in NMT 900, AMPS, TACS, GSM, or PDC, and the high frequency elements operate in DCS 1800, PCS 1900, or WCDMA.

* * * * *